United States Patent [19]

Ito et al.

[11] Patent Number: 4,577,863

[45] Date of Patent: Mar. 25, 1986

[54] SWING MEASURING DEVICE

[75] Inventors: Sho Ito; Kenji Tatsumi; Kumio Kasahara; Tomoyuki Nakaguchi; Toshio Takei; Shojiro Nakahara, all of Kanagawa, Japan

[73] Assignee: Mitsubishi Denki Kabushiki Kaisha, Tokyo, Japan

[21] Appl. No.: 510,098

[22] Filed: Jul. 1, 1983

[30] Foreign Application Priority Data

Jul. 1, 1982 [JP] Japan ..... 57-114623

[51] Int. Cl.[4] ..... A63B 71/02

[52] U.S. Cl. ..... 273/26 R; 273/26 B; 273/186 A; 273/186 C; 434/247

[58] Field of Search ..... 273/26 R, 26 A, 26 B, 273/32 H, 72 R, 181 H, 181 E, 181 A, 181 G, 186 R, 186 A, 186 B, 186 C, 186 RA; 350/169; 356/373, 375; 434/247

[56] References Cited

U.S. PATENT DOCUMENTS

| | | | |
|---|---|---|---|
| 3,117,451 | 1/1964 | Ray | 273/26 R |
| 4,150,825 | 4/1979 | Wilson | 273/181 H |
| 4,306,722 | 12/1981 | Rusnak | 273/186 R |
| 4,367,009 | 1/1983 | Suzki | 350/169 |
| 4,461,477 | 7/1984 | Stewart | 273/26 R |

FOREIGN PATENT DOCUMENTS

| | | | |
|---|---|---|---|
| 1190564 | 5/1970 | United Kingdom | 350/169 |

*Primary Examiner*—Richard C. Pinkham
*Assistant Examiner*—MaryAnn Stoll Lastova
*Attorney, Agent, or Firm*—Sughrue, Mion, Zinn, Macpeak, and Seas

[57] ABSTRACT

The height and inclination of a batter's swing plane are measured by a batting practice device shaped like a home plate and including a laser source and photosensors for detecting laser light reflected by the bat when swung over the plate.

19 Claims, 8 Drawing Figures

SWING MEASURING DEVICE

BACKGROUND OF THE INVENTION

This invention relates to a swing measuring device for measuring the inclination and height of the swing plane of a baseball bat, and the speed of the bat.

A swing measuring device of this type which can be used in an open area has not been available. Accordingly, in order to train baseball players, it has been necessary to provide a special area in a gymnasium under safety control. Thus, it has been rather difficult to train baseball players with high efficiency.

SUMMARY OF THE INVENTION

In view of the foregoing, an object of this invention is to provide a swing measuring device which comprises a laser oscillator for outputting a laser beam of high directivity provided in a home plate-shaped sensor unit, and light receiving elements and optical systems for receiving laser beams reflected from the baseball bat, so that the inclination and height of the swing plane of the bat and the speed of the bat may be measured without contacting the baseball player.

DETAILED DESCRIPTION OF THE PREFERRED EMBODIMENTS

Figure 1A:
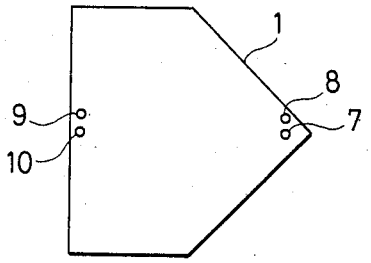
FIGS. 1(*a*) and (*b*) and 2 are explanatory diagrams describing the principles of this invention, FIG. 1(*c*)showing a state in which a measuring device according to the invention is used.
Figure 1B:
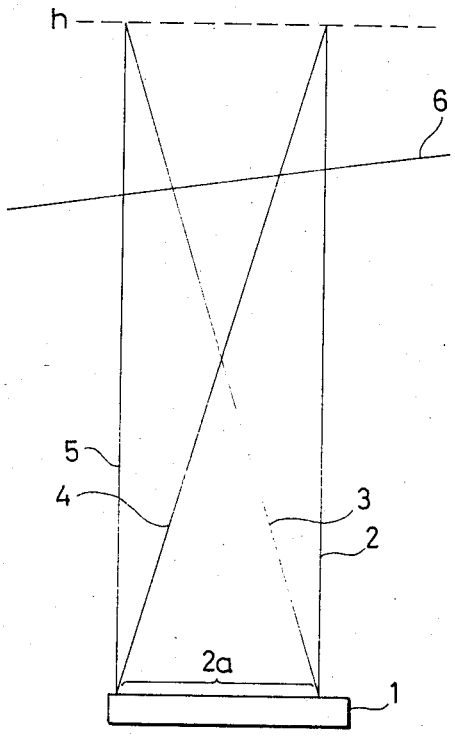
Figure 1C:
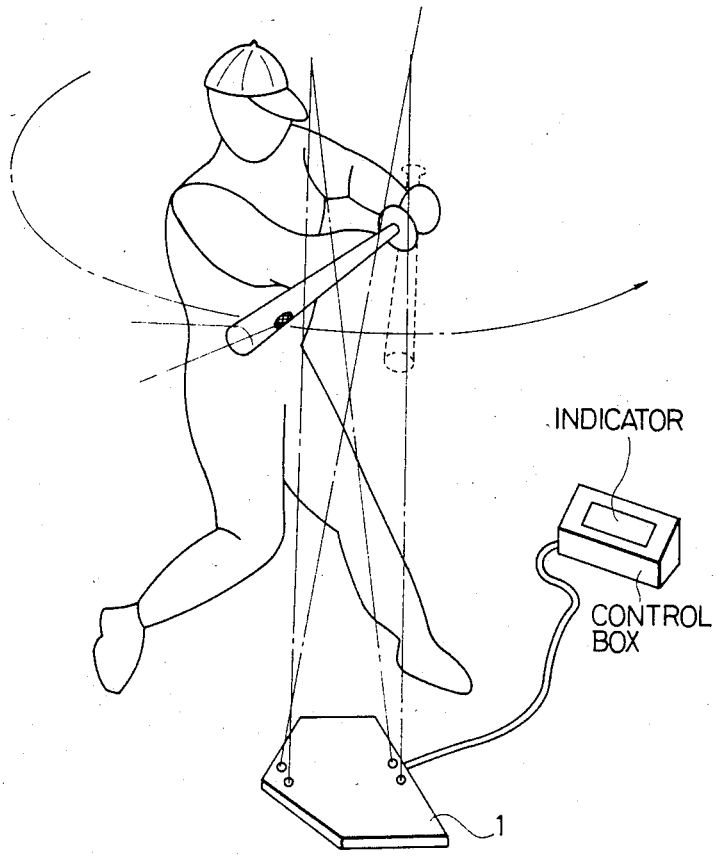

FIG. 1 is a diagram describing the operating principles of this invention. In FIG. 1*a*, reference numeral 1 designates a sensor unit incorporating a laser oscillator adapted to emit a laser beam of high directivity, an optical system for transmitting the output laser beam of the laser oscillator, light receiving elements for receiving laser beams reflected from a baseball bat, and a mechanism for fixedly securing these components and circuit elements. The sensor unit is in the form of a home-plate. In FIGS. 1*a* and 1*b*, numeral 2 represents a first laser beam emitted vertically upwardly of the sensor unit 1; 3, a second laser beam which intersects a fourth laser beam (described later) at a height h from the sensor unit 1; 4, a third laser beam which intersects the first laser beam at the same height h from the sensor unit 1; 5, the fourth laser beam which is spaced by a distance 2*a* from the first laser beam 2 and is emitted vertically upwardly of the sensor unit 1; 6, the line of intersection of the swing plane of the bat and the vertical plane determined by the above-described four laser beams, and 7 through 10, holes for emitting the first through fourth laser beams 2 to 5, respectively.

Figure 2:
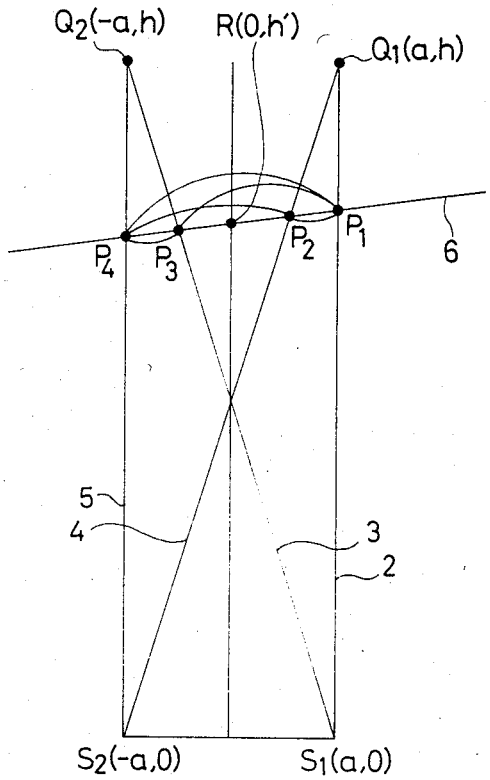

Let the intersection of the first and third laser beams 2 and 4 be $Q_1$ and its coordinates (a, h) (FIG. 2). Let the intersection of the second and fourth laser beams 3 and 5 be $Q_2$ and its coordinates (−a, h). Furthermore, let the angle formed by the line of intersection 6 and the horizontal plane be $\theta$, and let the height of the intersection of the line 6 and the vertical bisector of $Q_1Q_2$ be h'. In addition, let the intersections of the line 6 and the first, third, second and fourth laser beams be $P_1$, $P_2$, $P_3$ and $P_4$, respectively. Then, the coordinates of these points are as follows: (FIG. 2 will facilitate an understanding of the above description.)

$S_1$: (a, 0)

$S_2$: (−a, 0)

$P_1$: (a, a tan $\theta$+h')

$$P_2: \left( \frac{h' - \frac{h}{2}}{\frac{h}{2a} - \tan\theta}, \frac{h' - \frac{h}{2}}{\frac{h}{2a} - \tan\theta} \tan\theta + h' \right)$$

$$P_3: \left( \frac{h' - \frac{h}{2}}{-\frac{h}{2a} - \tan\theta}, \frac{h' - \frac{h}{2}}{-\frac{h}{2a} - \tan\theta} \tan\theta + h' \right)$$

$P_4$: (−a, −a tan $\theta$+h')

$Q_1$: (a, h)

$Q_2$: (−a, h)

$R_1$: (0, h')

Therefore, the lengths of segments $\overline{P_1P_2}$, $\overline{P_2P_4}$, $\overline{P_1P_3}$, $\overline{P_3P_4}$ and $\overline{P_1P_4}$ are as follows:

$$P_1P_2 = \left( a - \frac{h' - \frac{h}{2}}{\frac{h}{2a} - \tan\theta} \right) (1 + \tan^2\theta)^{\frac{1}{2}} \tag{1}$$

$$P_2P_4 = \left( a + \frac{h' - \frac{h}{2}}{\frac{h}{2a} - \tan\theta} \right) (1 + \tan^2\theta)^{\frac{1}{2}} \tag{2}$$

$$P_1P_3 = \left( a + \frac{h' - \frac{h}{2}}{\frac{h}{2a} + \tan\theta} \right) (1 + \tan^2\theta)^{\frac{1}{2}} \tag{3}$$

$$P_3P_4 = \left( a - \frac{h' - \frac{h}{2}}{\frac{h}{2a} + \tan\theta} \right) (1 + \tan^2\theta)^{\frac{1}{2}} \tag{4}$$

$$P_1P_4 = 2a(1 + \tan^2\theta)^{\frac{1}{2}} \tag{5}$$

From the above expressions, the ration $r_2$ of segment $\overline{P_1P_2}$ to segment $\overline{P_2P_4}$ and the ratio $r_3$ of segment $\overline{P_1P_3}$ to segment $\overline{P_3P_4}$ are as follows:

$$r_2 = \frac{\overline{P_1P_2}}{\overline{P_2P_4}} = \frac{h - h' - a\tan\theta}{h' - a\tan\theta} \tag{6}$$

$$r_3 = \frac{\overline{P_1P_3}}{\overline{P_3P_4}} \quad \frac{h' - a\tan\theta}{h - h' - a\tan\theta} \tag{7}$$

It is apparent from the above-described expressions (6) and (7) that, when $r_2$ and $r_3$ are calculated from measured parameters, the height h' of the swing plane of the bat and the inclination $\theta$ of the swing plane with respect to the ground can be obtained because a and h are device constants.

If expression (5) is converted into expression (8) (described below), then the swing speed v of the bat can be obtained using the value $\theta$ obtained as above from the difference between the time when the bat crosses the first laser beam and the time it crosses the fourth laser beam.

$$P_1P_4 = v \cdot \Delta t = 2a \cdot (1 + \tan^2\theta)^{\frac{1}{2}} \quad (8)$$

The following three equations (9), (10) and (11) directly represent h', $\theta$ and v with the measured data $r_2$, $r_3$ and $\Delta t$ and the device constants h and a:

$$h' = \frac{r_2 \cdot r_3 - 2r_3 + 1}{2(r_2 - r_3)} \cdot h \quad (9)$$

$$\theta = \tan^{-1}\left(\frac{1}{r_3 - 1}\left\{(r_3 + 1)\frac{h'}{a} - r_3 \cdot \frac{h}{a}\right\}\right. \quad (10)$$

$$v = \frac{2a}{\Delta t}\sqrt{1 + \tan^2\theta} \quad (11)$$

The operating principles of the invention are as described above. Now, the construction and operation of a device for deriving the data $r_2$, $r_3$ and t from measured values, which are necessary in obtaining the data h', $\theta$ and v, will be described in detail.

Figure 3:
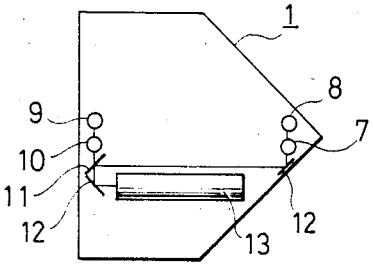
FIGS. 3 and 4 are diagrams mainly showing the arrangement of optical components in a sensor unit of a swing measuring device according to the invention.

FIG. 3 is a top view showing the arrangement of the optical components, electrical components and a laser oscillator in the sensor unit 1. In FIG. 3, reference numeral 11 designates a half-mirror; 12, total reflection mirrors; and 13, the laser oscillator. Further in FIG. 3, the straight lines between the above-described components are the output laser beams of the laser oscillator 13.

Figure 4:
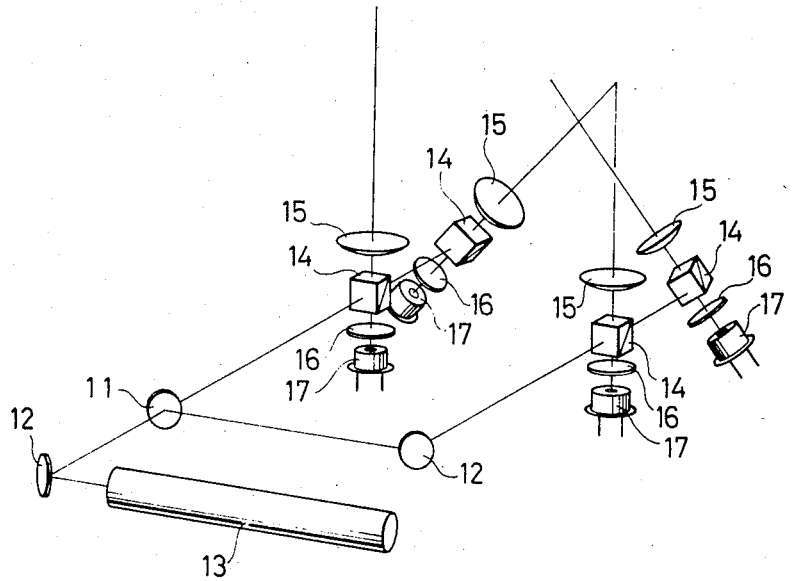

FIG. 4 is a perspective view showing the arrangement of the optical components in the sensor unit 1 in detail. In FIG. 4, reference numeral 14 designates beam splitter cubes for splitting a laser beam into two parts; 16, lenses, each of which is adapted to apply to a respective photodetector (described later) the laser beam which is reflected towards the respective light emitting hole from the bat when the latter is swung above the sensor unit 1; 15, filters for transmitting only the laser beam of the laser oscillator 13; and 17, the photodetectors (mentioned above) for detecting the laser beam with high sensitivity.

Figure 5:
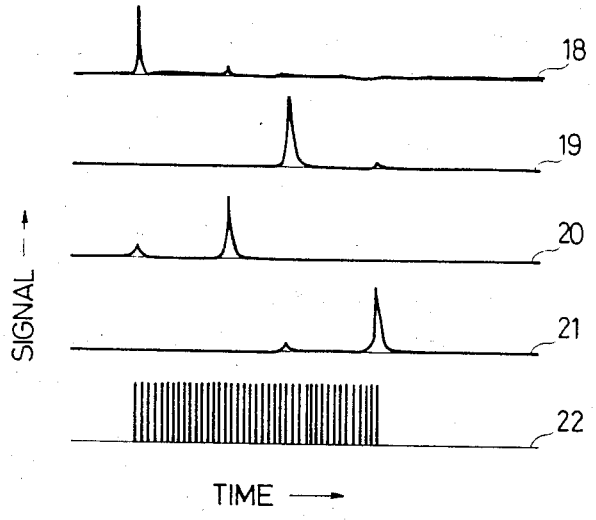
FIG. 5 is a time chart showing the signals received by four photo-detectors in the sensor unit.

The sensor section 1 is constructed as described above. Therefore, as the bat moves along the line of intersection 6 in the $P_1$-to-$P_4$ direction, the four photodetectors produce light receiving signals as shown in FIG. 5. Accordingly, if the distance between the main pulses of the light receiving signals 20 and 21 is measured, its value is proportional to the segment $\overline{P_2P_4}$ in FIG. 2. Similarly, the distance between the main pulses of the light receiving signals 18 and 20 is proportional to segment $\overline{P_1P_2}$. The ratio of these distances is $r_2$ of expression (6). In FIG. 5, reference numeral 22 designates a clock pulse train which is extracted, showing the distance between the light receiving signals 18 and 21. The number of clock pulses is proportional to the time interval $\Delta t$ of expression (8).

Figure 6:
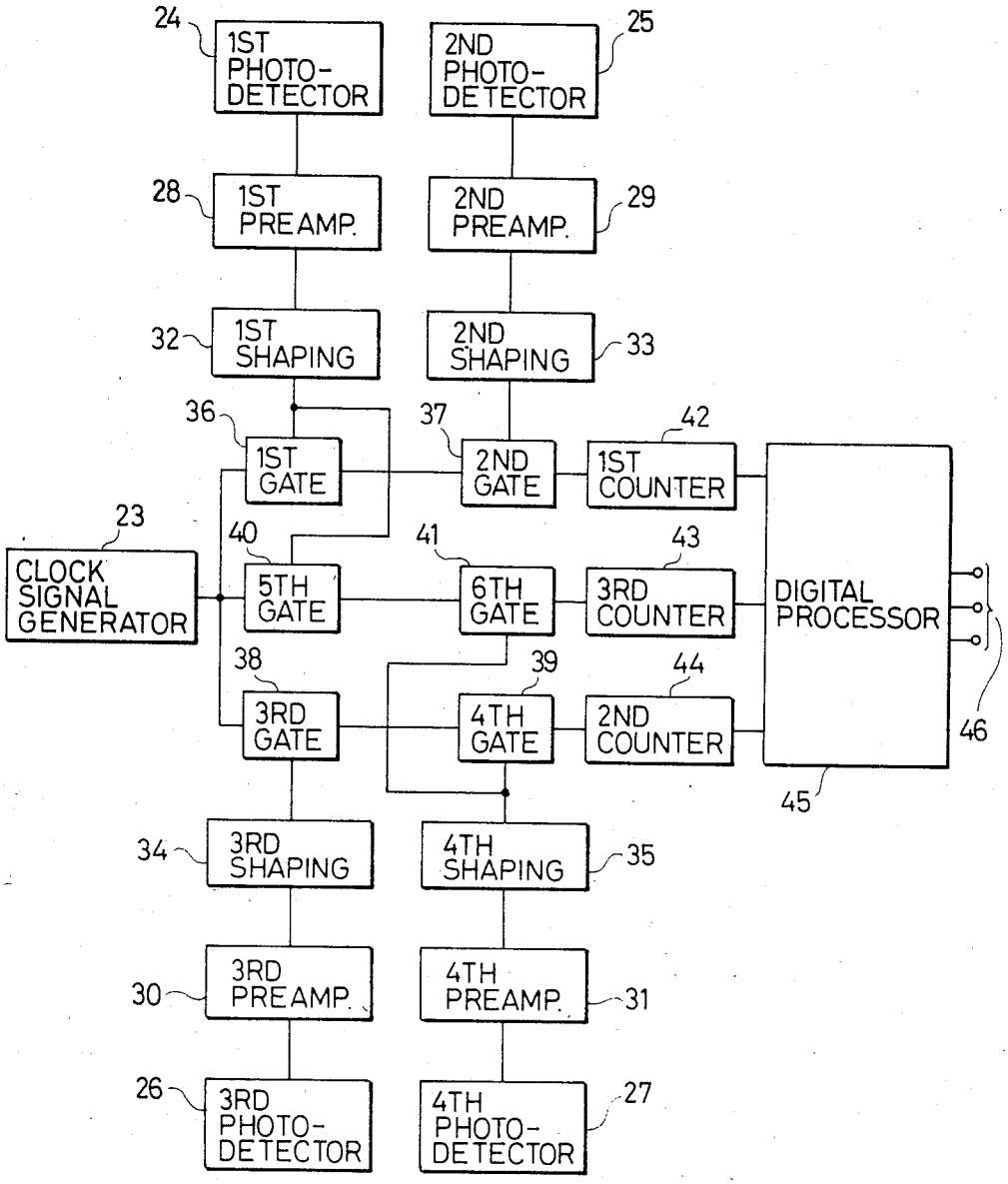
FIG. 6 is a block diagram for the sensor unit.

FIG. 6 is a diagram showing a signal processing circuit for the swing measuring device with which the invention is concerned. In FIG. 6, reference numeral 23 denotes a clock signal generator having a generated frequency of 2 MPPS. Numerals 24 through 27 denote first through fourth photodetectors generating signals 18 through 21 as shown in FIG. 5. Numerals 28 to 31 denote preamplifiers. Reference numerals 32 to 35 denote first to fourth shaping circuits for binary-coding and shaping the outputs of the preamplifiers 28 to 31 with threshold voltages adjusted in advance. Reference numerals 36 to 41 denote first to sixth gate circuits for determining an output signal of the clock signal generator 23 in accordance with the signals of the first to fourth shaping circuits 31 to 35. Reference numerals 42 to 44 denote first to third counter circuit for counting the output, determined by the operations of the first to sixth gate circuits 36 to 41, of the clock signal generator 23, that is, the number of pulses in the three pulse trains. Reference numeral 45 denotes a digital computer or processor for calculating the height of swing plane and the inclination thereof and the swing speed of the baseball bat on the basis of the predetermined beam interval 2a and the height h of the beam intersection. Reference numeral 46 denotes output terminals of the processor 45. A specific operation of the thus constructed circuitry will be quite obvious for those skilled in the art. Therefore, a detailed explanation therefor has been omitted. It should be noted that in FIG. 5, the pulse trains which are determined by the above described circuitry and to be inputted into the third counter circuit 43 is designated by reference numeral 22.

The second unit of FIG. 4 employs four photodetectors 17 of similar configuration. In order to improve productivity, the number of photodetectors may be reduced to two or even one by increasing the distance between the photodetector and the beam splitter cube.

Although concrete methods of calculating the data h', $\theta$ and v of the swing indicated by expressions (9), (10) and (11) have not been described, these data are preferably calculated by a digitial computer contained in the device. The implementation of such and methods of displaying the data will be quite obvious to those of skill in the art.

As is clear from the above description, in the swing measuring device of the invention, a laser oscillator 13 for emitting a laser beam of high directivity and various optical components are built into a home-plate-shaped sensor unit, to emit four laser beams, so that the speed of movement, the inclination with respect to the ground and the height from the ground of a baseball bat can be determined from the time intervals required for the bat to cross the four laser beams. Thus, the device of the invention is advantageous in that these three factors can be determined merely from the values of light receiving signals from photodetectors.

What is claimed is:

1. A swing measuring device, comprising:

a laser oscillator disposed in a sensor unit, and optical means for splitting the output laser beam of said laser oscillator into first, second, third and fourth laser beams;

said optical means being arranged such that first and fourth laser beams are emitted in a manner such that said first and fourth laser beams are spaced from one another and are emitted perpendicularly to said sensor unit, said second laser beam is emitted from substantially the same location of said sensor unit as that from which said first laser beam is emitted, in a manner such that said second laser beam intersects said fourth laser beam at a first predetermined height above said sensor unit, and such that said third laser beam is emitted from substantially the same location of said sensor unit, and such that said third laser beam is emitted from substantially the same location of said sensor unit as that from which said fourth laser beam is emitted, in a manner such that said third laser beam intersects said first laser beam at a second predetermined height above said sensor unit;

means for measuring the time intervals required for a swinging object to cross said respective four laser beams; and means for calculating the height and inclination of said swinging object's swing plane and the speed of said swinging object from said time intervals.

2. A device as claimed in claim 1, wherein said sensor unit is shaped as a home-plate, and said swinging object is a bat swung above said plate.

3. A device as claimed in claim 1, said optical means including plural mirrors for guiding an output laser beam, and beam splitters for forming said first through fourth laser beams.

4. A device as claimed in claim 1, said optical means further including at least one photodetector for detecting laser light reflected from said swinging object.

5. A device as claimed in claim 4, including four photodetectors arranged generally in alignment with said respective four laser beams.

6. A device as claimed in claim 1, said first and fourth laser beams being spaced on the order of several tens of centimeters from one another.

7. A device as claimed in claim 1, said first and second predetermined heights being equal, and on the order of a meter above said sensor unit.

8. A swing measuring device, comprising:

a sensor unit having at least four holes;

means for emitting at least four beams through said holes upwardly so that at least one beam of said at least four beams is oblique with respect to the other beams, said emitting means being located within said sensor unit;

beam receiving means including at least four associated beam receiving elements for receiving through said holes the beams reflected from a baseball bat when the baseball bat transverses said beams, said beam receiving means being located within said sensor unit; and means for generating output signals when said beam receiving means receives the reflected beams, said output signals being in combination representative of a period of time during which the baseball bat transverses said at least four beams;

wherein a height of a swing plane, an inclination thereof and a speed of the baseball bat are measured in accordance with said output signals of said generating means.

9. The device as claimed in claim 8, wherein said holes include first, second, third and fourth holes, said second being located in the vicinity of said first hole, said fourth hole being located in the vicinity of said third hole, said third and fourth holes being spaced from said first and second holes at a predetermined interval in a swing direction of the baseball bat, and said at least four beams include first, second, third and fourth beams, said first and fourth beams being emitted to pass through said first and fourth holes in parallel with each other, said second beams intersecting through said second hole with said fourth beam and said third beam intersecting through said third hole with said first beam.

10. The device as claimed in claim 9, wherein a height of the intersection between said second beam and said fourth beam and a height of the intersection between said first beam and a third beam are at a higher level than the swing plane by a predetermined distance.

11. The device as claimed in claim 9, wherein said first and fourth beams are emitted upwardly in a direction perpendicular to a surface of said sensor unit.

12. The device as claimed in claim 9, wherein the inclination of said second beam with respect to said first beam is substantially the same as that of said third beam with respect to said fourth beam.

13. The device as claimed in claim 9, wherein said first, second, third and fourth holes are oriented substantially in a direction perpendicular to the swing plane.

14. The device according to claim 8, said emitting means comprising a laser oscillator and optical means for splitting the output laser beam of said laser oscillator into said at least four beams.

15. The device as claimed in claim 8, wherein said sensor unit is in the form of a home-plate.

16. A swing measuring device, comprising:

a sensor unit having a first hole, a second hole located in the vicinity of said first hole, a third hole spaced apart a predetermined distance from said first and second holes in a swing direction of a baseball bat and a fourth hole located in the vicinity of said third hole, beam emitting means located within said sensor emitting a first beam through said first hole and a fourth beam through said fourth hole, wheren said first beam is parallel to said fourth beam, a second beam through said beam through said second hole in such a manner that said second beam intersecting with said fourth beam is at a position above a swing plane of the baseball bat, and a third beam through said third hole in such a manner that said third beam intersects with said first beam at a position above the swing plane of the baseball bat, an inclination of said third beam with respect to said fourth beam being substantially the same as that of said second beam with respect to said first beam, first, second, third and fourth beam receiving means located within said sensor unit for receiving through said first, second, third and fourth holes, respectively, beams reflected from the base ball bat when the baseball bat transverses said first, second, third and fourth beams whereupon output signals are generated, wherein a height of the swing plane, an inclination thereof and a speed of the baseball bat are measured in accordance with said output signals of said receiving means.

17. The device as claimed in claim 16, wherein said first, second, third and fourth holes are oriented in a swing direction of the baseball bat, respectively.

18. The device as claimed in claim 16, said beam emitting means comprising a laser oscillator and optical means for splitting the output laser beam of said laser oscillator into said at least four beams.

19. The device as claimed in claim 16, wherein said sensor unit is in the form of a home-plate.

* * * * *